US005352178A

United States Patent [19]

Pazdernik

[11] Patent Number: 5,352,178

[45] Date of Patent: Oct. 4, 1994

[54] COLLAPSED, TUBULAR CARTON ERECTING APPARATUS

[75] Inventor: Irvan L. Pazdernik, Alexandria, Minn.

[73] Assignee: Douglas Machine Limited Liability Company, Alexandria, Minn.

[21] Appl. No.: 89,042

[22] Filed: Jul. 9, 1993

Related U.S. Application Data

[63] Continuation-in-part of Ser. No. 17,480, Feb. 12, 1993.

[51] Int. Cl.[5] ..... B31B 3/52

[52] U.S. Cl. ..... 493/316; 493/183; 493/137; 53/491

[58] Field of Search ..... 493/136, 137, 156, 157, 493/183, 316, 317; 53/159, 374, 380, 491

[56] References Cited

U.S. PATENT DOCUMENTS

| | | | |
|---|---|---|---|
| 1,058,522 | 4/1913 | Auchu | 493/308 |
| 1,123,976 | 1/1915 | Auchu | 493/308 |
| 2,289,820 | 7/1942 | Ardell . | |
| 3,323,283 | 6/1967 | Johnson, Jr. et al. | 53/566 |
| 4,061,081 | 12/1977 | Pinto et al. | 493/317 |
| 4,133,254 | 1/1979 | Odom et al. . | |
| 4,854,930 | 8/1989 | Miselli et al. | 493/317 |
| 5,102,382 | 4/1992 | Center | 493/183 |
| 5,102,385 | 4/1992 | Calvert | 493/317 |
| 5,106,359 | 4/1992 | Lott | 493/151 |
| 5,207,630 | 5/1993 | Decker et al. | 493/317 |

FOREIGN PATENT DOCUMENTS

| | | |
|---|---|---|
| 0160333 | 11/1985 | European Pat. Off. . |
| 2235153 | 2/1991 | United Kingdom . |

*Primary Examiner*—Jack W. Lavinder
*Attorney, Agent, or Firm*—Peterson, Wicks, Nemer & Kamrath

[57] ABSTRACT

An apparatus (10) for erecting collapsed, tubular cartons (12) is disclosed including a device (32) for removing the top carton (12) of a vertical stack of cartons (12) in a hopper (26) and moving it in a horizontal orientation to an operative position. In the operative position, the second side panel (16) of the collapsed carton (12) underlies at least the first end panel (18) which is in a linear arrangement with the first side panel (14). Suction cups (76) carried by a frame (74) are secured to the second side panel (16) in an attachment position and moved by a parallelogram linkage to an open position located vertically below and coinciding with the first side panel (14). In a first preferred form, the folded closure flaps (22–25) are held by a tape piece (116) applied by a taping machine (114) carried by the last tucking arm (106). In another preferred form, the folded closure flaps (22–25) are fan folded by rotating and sliding folding arms (140–143) of a device (120) so that tape pieces (116) or similar agents to hold the closure flaps (22–25) are not needed. An unload arm (84) is then pivoted about a first axis from a pickup position to a drop position and is simultaneously pivoted about a second axis from a first condition to a second condition to place the erected carton (12) in a chute (118) at an offset location and in a horizontal orientation. In the most preferred form, the unload arm (84) is pivoted about the second axis by a crank arm (98) secured to the unload arm (84) and a connector (100) having its opposite end secured to a stationary reference point when the unload arm (84) is pivoted about the first axis.

20 Claims, 8 Drawing Sheets

COLLAPSED, TUBULAR CARTON ERECTING APPARATUS

CROSS REFERENCE

The present application is a continuation-in-part of application Ser. No. 08/017,480 filed on Feb. 12, 1993 still pending.

BACKGROUND

The present invention generally relates to apparatus for erecting cartons from a collapsed condition, particularly to apparatus for erecting cartons of the tubular type from a collapsed condition, and specifically to apparatus for erecting tubular cartons which have been previously utilized or which have not been previously utilized.

Many types of products are stored and transported in cartons which hold multiple products. Once reaching their final destination, the products are removed from the carton such as for their retail sale, and the carton is disposed of. Although previously such used cartons were simply disposed of as waste, with increasing ecological and environmental awareness, such used cartons are often recycled. However, to further enhance the reduction of waste, it has become desirable for the cartons to be reused multiple times (such as on the average of eight times) before they are recycled or otherwise disposed of. It can then be appreciated that with the product removed, it is then desired that the carton be stored and transported in a flat or collapsed condition for space reduction to the factory or similar location where the carton is again erected or set up for reuse by again filling the carton with product.

Various types of packaging machines exist for erecting or setting up cartons from a blank or collapsed condition such as but not limited to U.S. Pat. No. 4,917,663. However, most existing packaging machines were designed to handle cartons which have not been previously utilized and which have not been previously erected or set up. Cartons which have been previously used and then returned to their flat or collapsed condition for reuse are not as rigid as new cartons and are more difficult to automatically, mechanically handle. Thus, many prior packaging machines had difficulty handling and erecting used cartons. This difficulty is further complicated as cartons at various stages of their lives from being new to being reused their first or second time to being reused their last time and thus of varying degrees of rigidity and ease of handling are intermixed in their collapsed condition in the carton magazine or hopper of the packaging machines.

Additionally, it is desired that the reuse of cartons be as competitive as possible with utilizing only new cartons in packaging in addition to the ecological advantages gained by reuse. Towards that end, it is desired that handling of the reused carton be made as minimal and as easy as possible. It can then be appreciated that collapsed cartons are typically transported back to the factory for reuse on pallets. Thus, it is desired that the collapsed cartons be easily loaded into the erecting apparatus from pallets or the like. Many prior packaging machines include carton magazines which are relatively difficult to load individual cartons from a vertical stack on a pallet.

Thus a need exists for apparatus for erecting or setting up cartons from their flat or collapsed condition which is able to handle without difficulty intermixed cartons at various stages of their lives and which allows ease and minimization of handling reused cartons from vertical stacks.

SUMMARY

The present invention solves this need and other problems in the field of packaging machines for setting up or erecting cartons from their flat or collapsed condition by providing, in the most preferred form, cartons placed at an operative position with first and second panels in a linear arrangement and a third panel vertically below and underlying at least the second panel and with a frame in an attachment position abutting and removably secured to the third panel and movable in a horizontal orientation to an open position vertically below and horizontally offset from the attachment position located vertically below and coinciding with the first panel, with the first panel being held while the frame and the third panel secured thereto move from the attachment position to the open position.

In a further aspect of the present invention, the carton is removed from the top of a stack of collapsed cartons and moved in a horizontal orientation in a half-circle arc to the operative position. In the preferred form, the collapsed carton is removably secured to a placement shaft which is rotatably mounted between first and second, pivotable placement arms, with the placement shaft maintaining the same horizontal orientation during the pivoting of the first and second placement arms.

In another aspect of the present invention, an arm to which the carton is removably attached is pivoted about a first axis between a first position and a second position and simultaneously pivoted about a second axis between a first condition and a second condition, with the second axis being perpendicular to the first axis, to move the carton to an offset location and at a different orientation.

In still further aspects of the present invention, the first and second major and minor bottom closure flaps are fan folded. In the preferred form, the first, outer corners of the closure flaps are all pushed simultaneously inward and forward prior to the second, opposite corners of the closure flaps until the closure flaps extend generally perpendicular to the side panels of the carton. In the most preferred form, the second, opposite corners of the closure flaps are held when the closure flaps are initially pushed to insure that the first corners of the closure flaps are positioned forward of the second corners of the closure flaps when the closure flaps extend generally perpendicular to the side panels of the carton.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
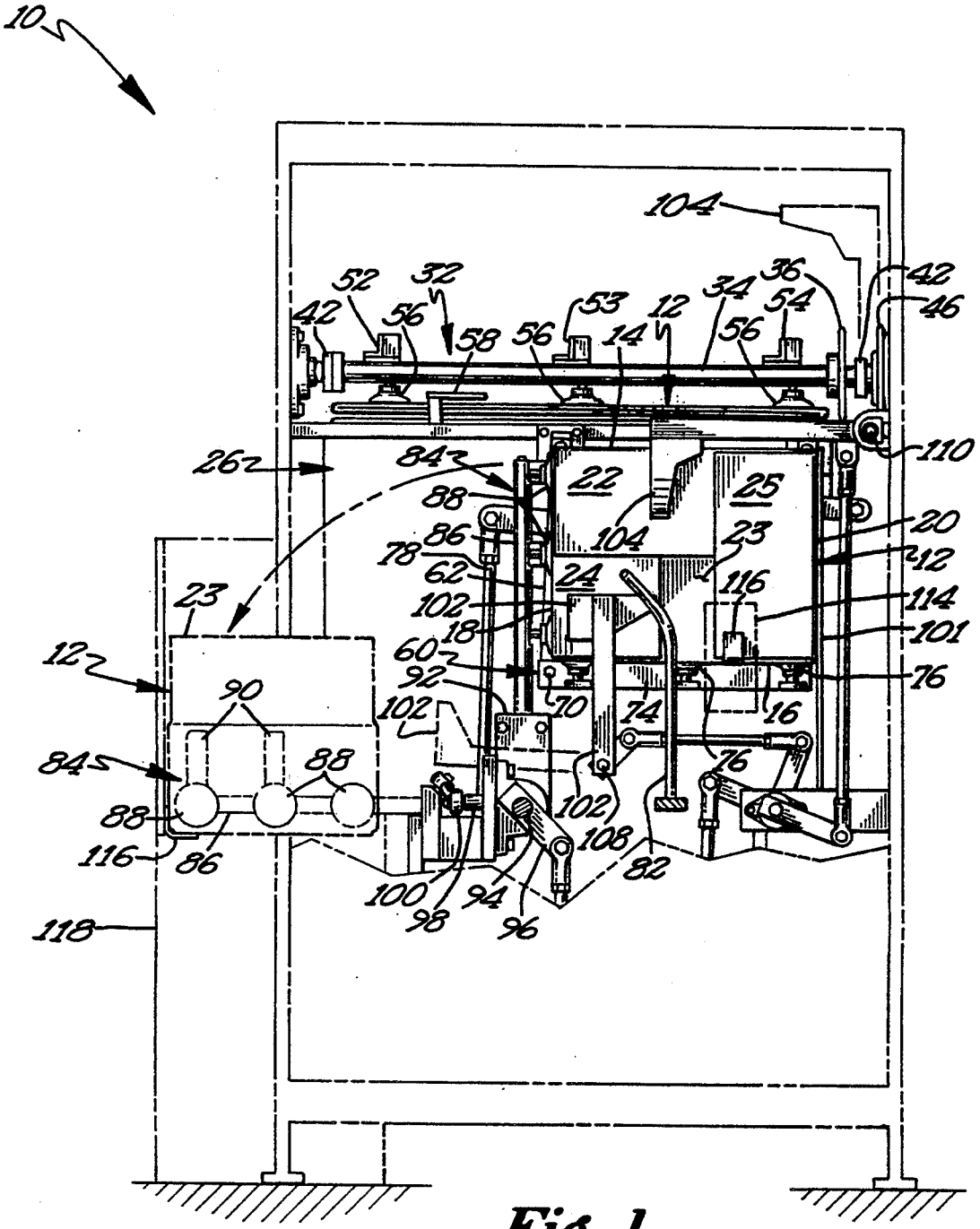
FIG. 1 shows a front, end view of an apparatus for erecting collapsed, tubular cartons according to the preferred teachings of the present invention, with portions shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

Apparatus for opening or erecting cartons according to the preferred teachings of the present invention is shown in the drawings and generally designated 10. Although apparatus 10 and the carton erecting method performed thereby may be utilized with cartons of various configurations, apparatus 10 is designed primarily for opening cartons 12 of the type illustrated in the drawings. Such cartons 12 generally comprise a plurality of body walls, such as side panels 14 and 16 and end panels 18 and 20 which are hingedly connected together along hinge connections into an annularly continuous tubular configuration in any suitable manner. Such body walls may have any suitable dimensional relationship, but in the embodiment illustrated, side panels 14 and 16 are of a width somewhat greater than the width of end panels 18 and 20. All of such walls have equal length, however. In the collapsed condition, panels 16 and 20 are vertically below, underlie, and are in contact with the inner surfaces of panels 14 and 18.

Hingedly connected to carton 12 at opposite ends thereof are carton closure means in the form of opposite cooperable pairs of closure flaps 22–25 which are intended to seal the top and bottom of carton 12. Corresponding flaps 22–25 at opposite ends of carton 12 generally are identical. Particularly, hingedly connected to the margin of each of side panels 14 and 16 are upper and lower major closure flaps 22 and 23, respectively. A pair of minor end closure side flaps 24 and 25 are hingedly connected to margins of opposite end panels 18 and 20, respectively. When carton 12 is collapsed, major flaps 22 and upper minor flaps 24 are vertically above, overlie and contact the inner faces of lower major flaps 23 and lower minor flaps 25.

Minor flaps 24 and 25 are of substantially less width than major flaps 22 and 23 so that the outer free edges of flaps 22 and 23 extend longitudinally of carton 12 beyond the outer free edges of minor flaps 24 and 25.

Figure 2:
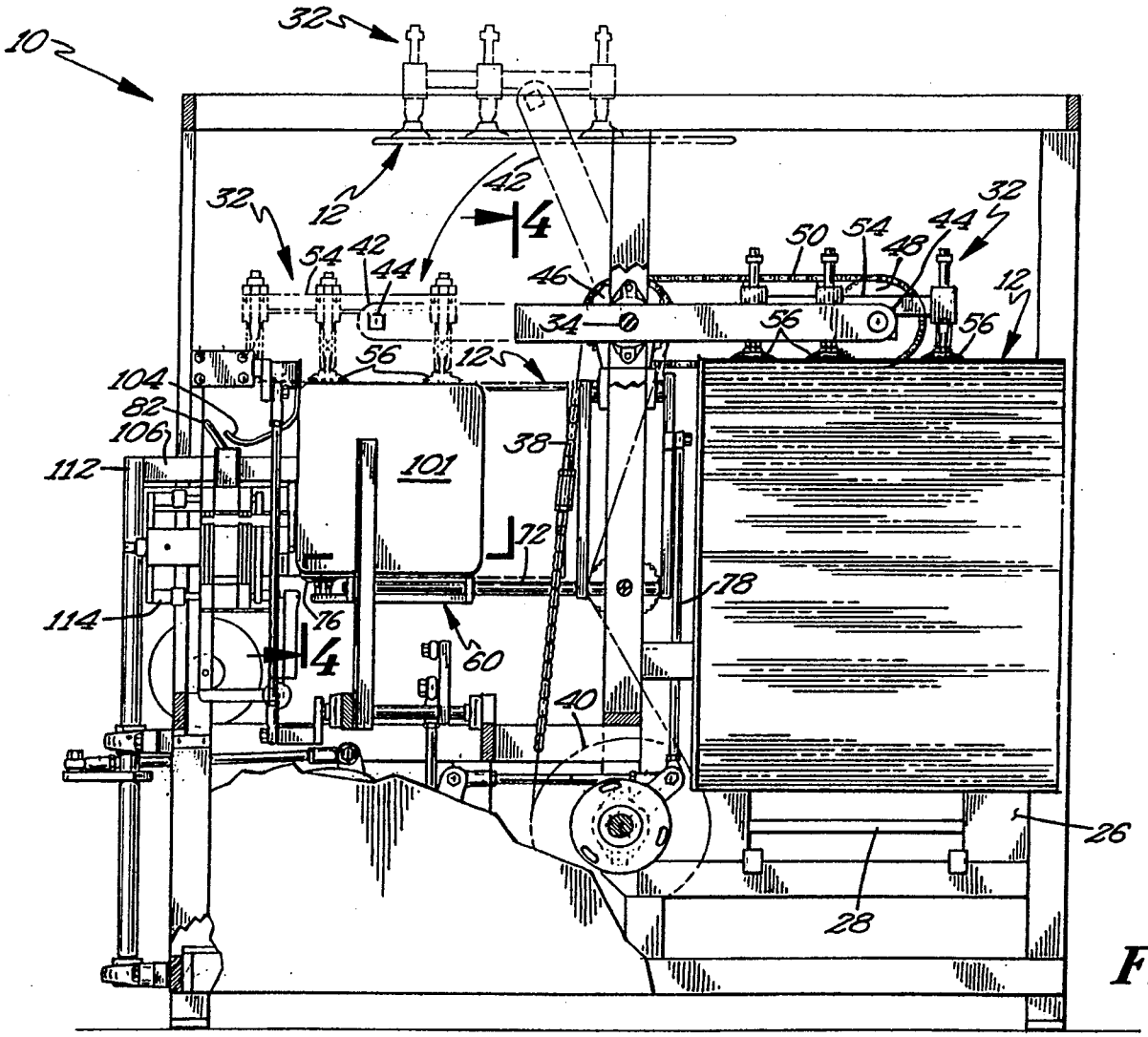
FIG. 2 shows a side elevational view of the apparatus of FIG. 1, with portions broken away for ease of illustration.
Figure 3:
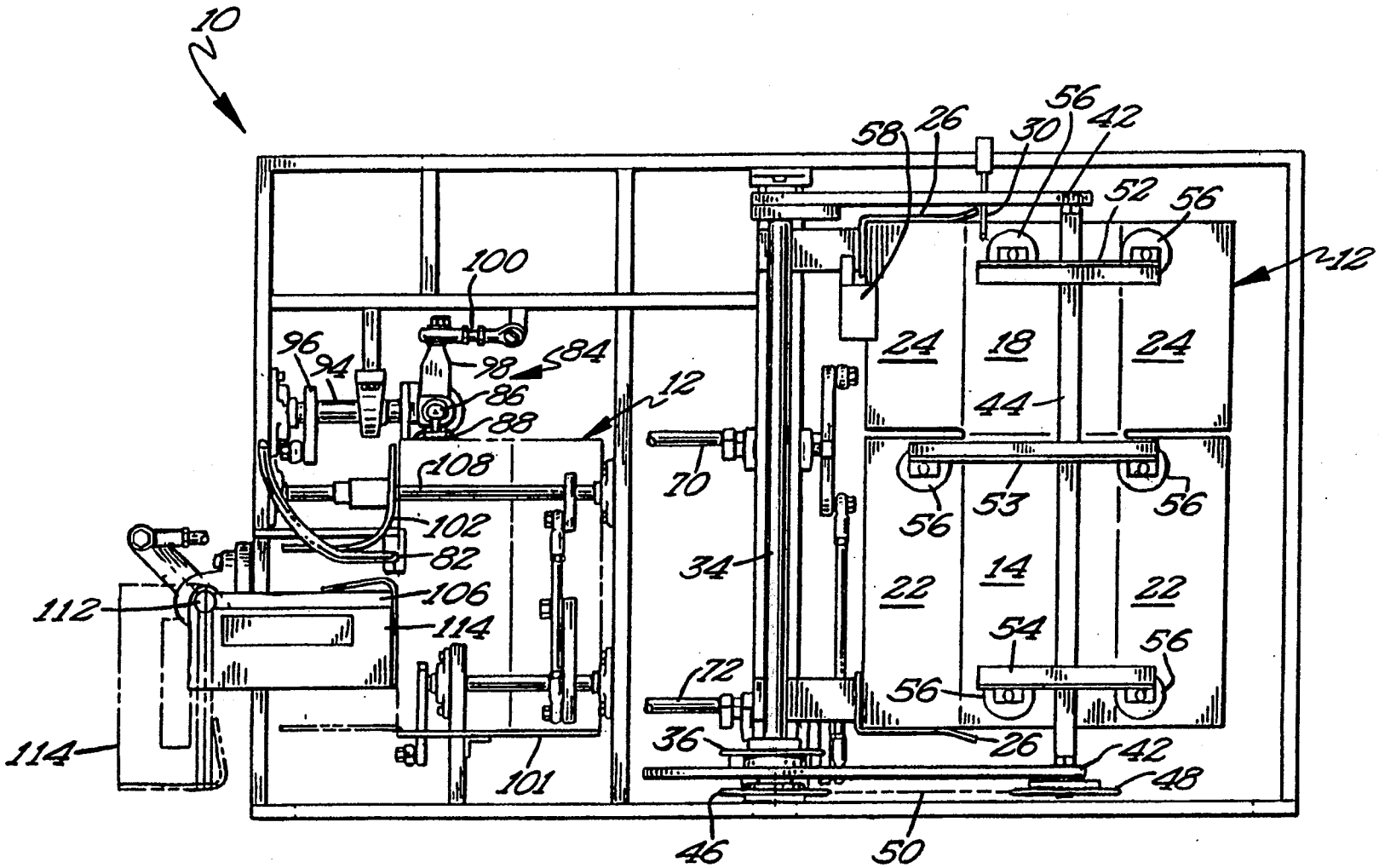
FIG. 3 shows a top plan view of the apparatus of FIG. 1, with portions broken away for ease of illustration.
Figure 4:
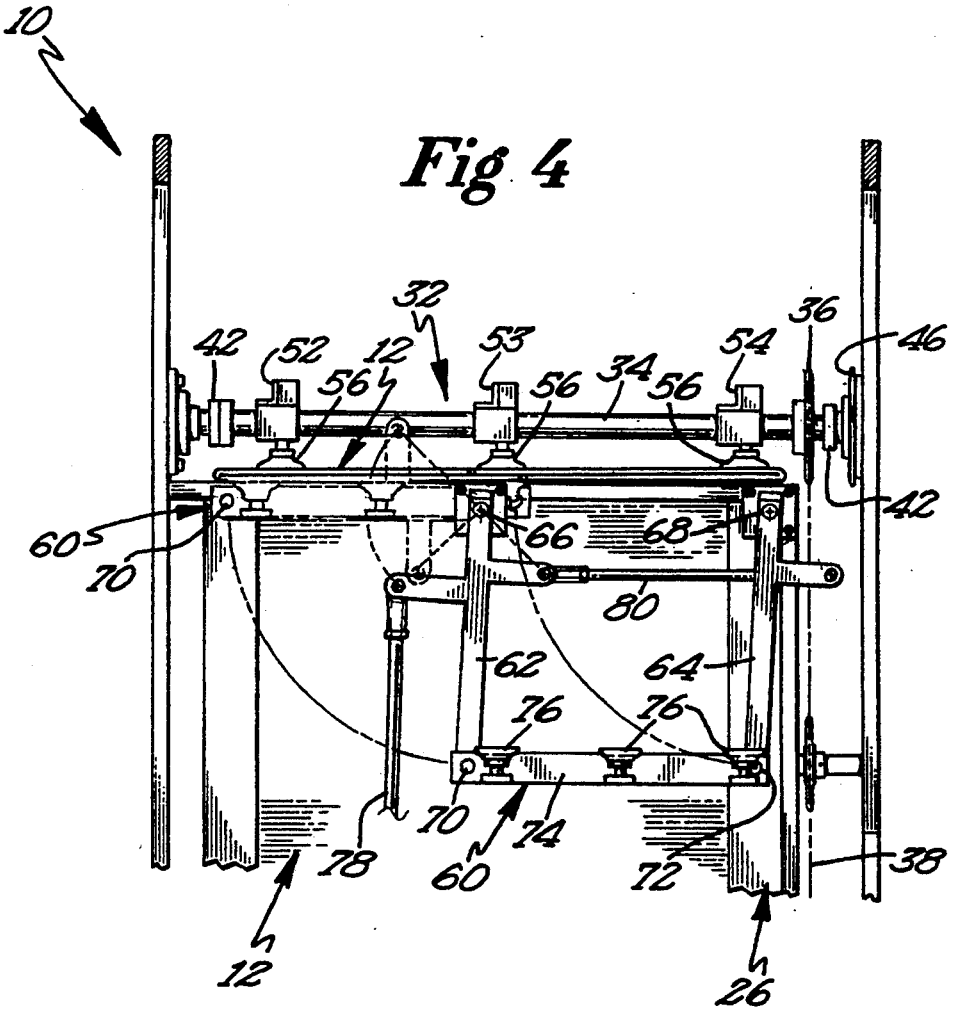
FIG. 4 shows a cross-sectional view of the apparatus of FIG. 1 according to section line 4—4 of FIG. 2.
Figure 7:
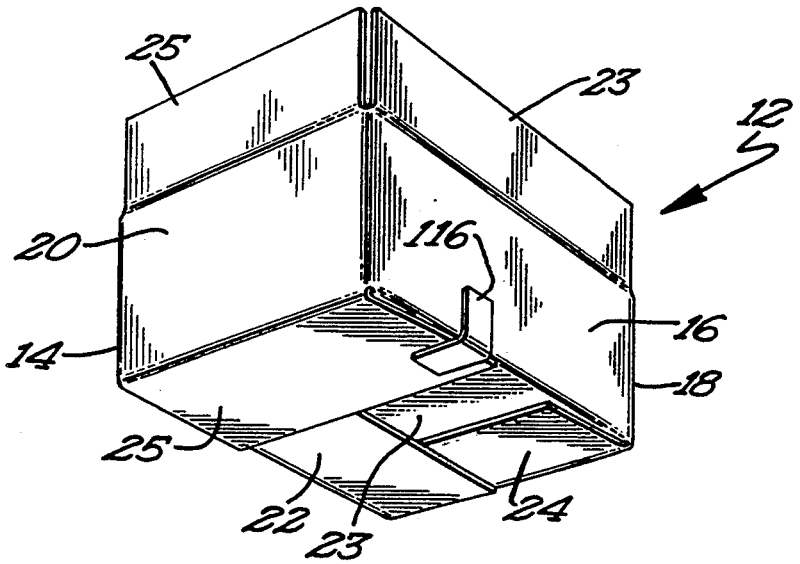
FIG. 7 shows a perspective view of a carton as erected by the apparatus of FIG. 1.
Figure 5:
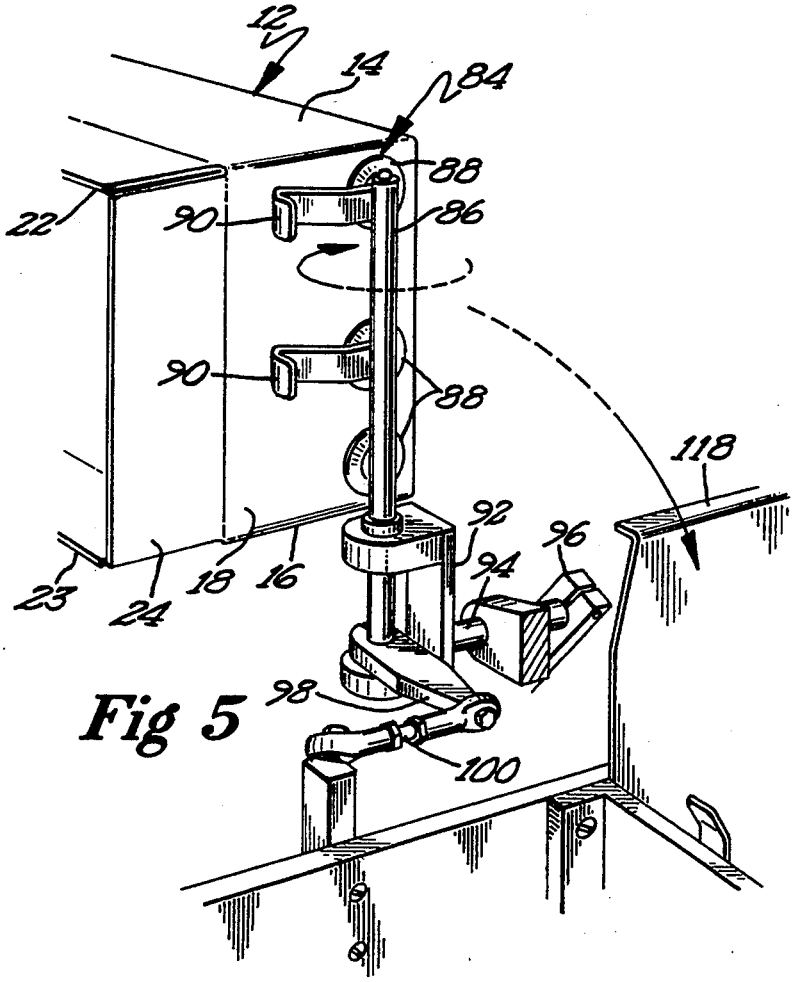
FIG. 5 shows a partial, perspective view of the unload arm of the apparatus of FIG. 1 in its pickup position
Figure 6:
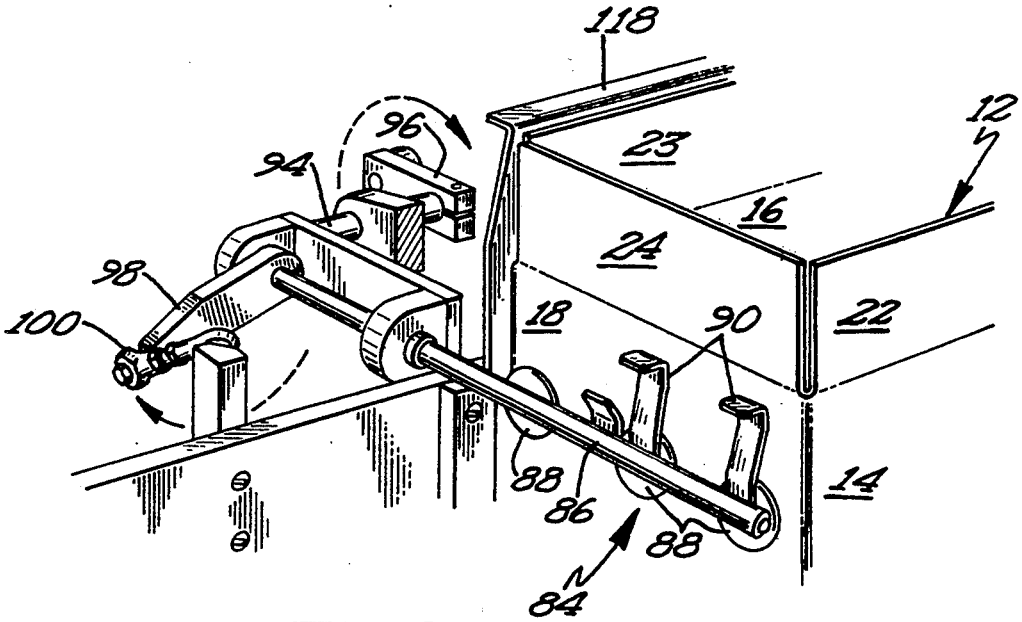
FIG. 6 shows a partial, perspective view of the unload arm of the apparatus of FIG. 1 in its drop position.
Figure 8:
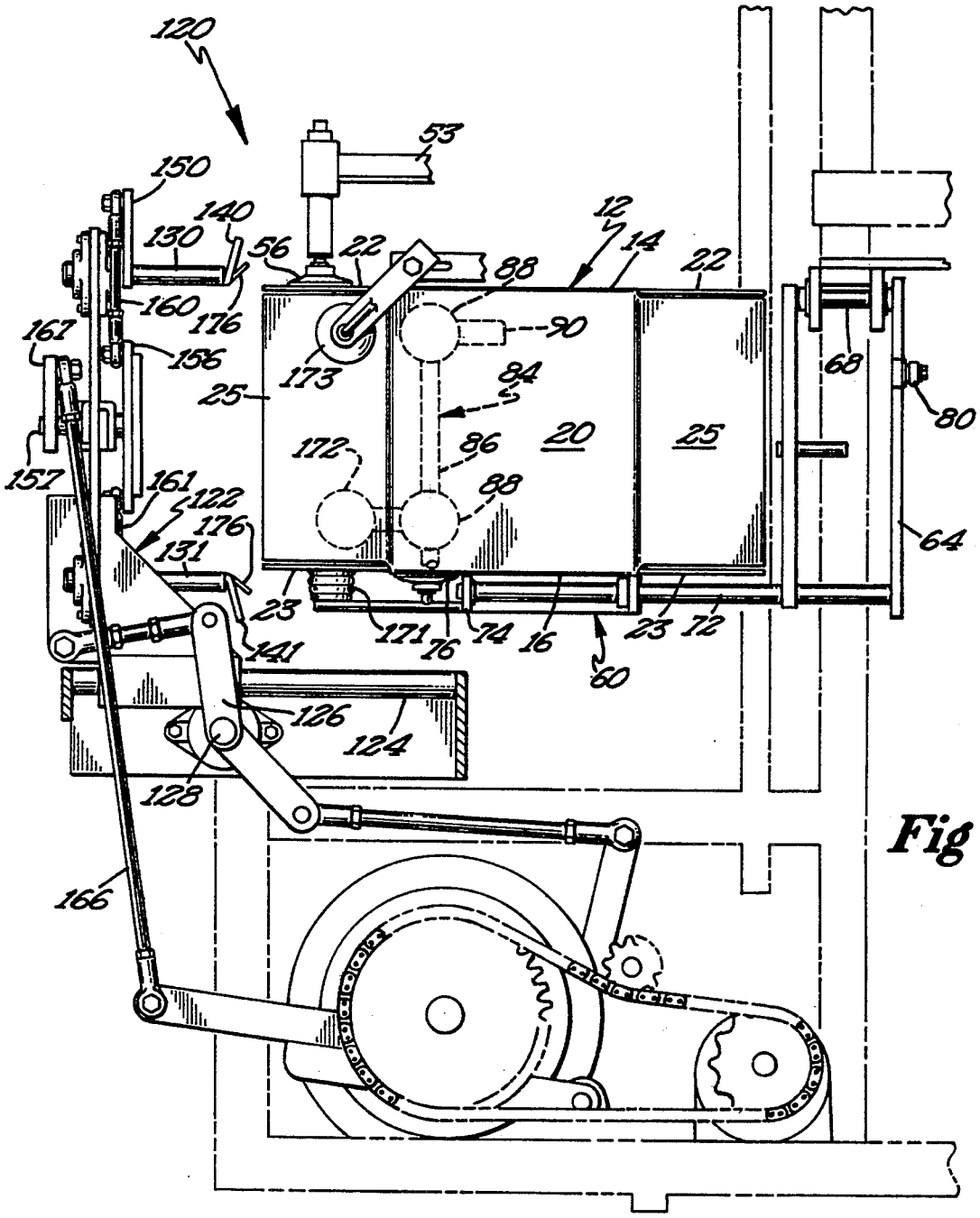
FIG. 8 shows a partial, side elevational view of a device for fan folding the bottom closure flaps of the carton for the apparatus of FIG. 1 according to the preferred teachings of the present invention.
Figure 9:
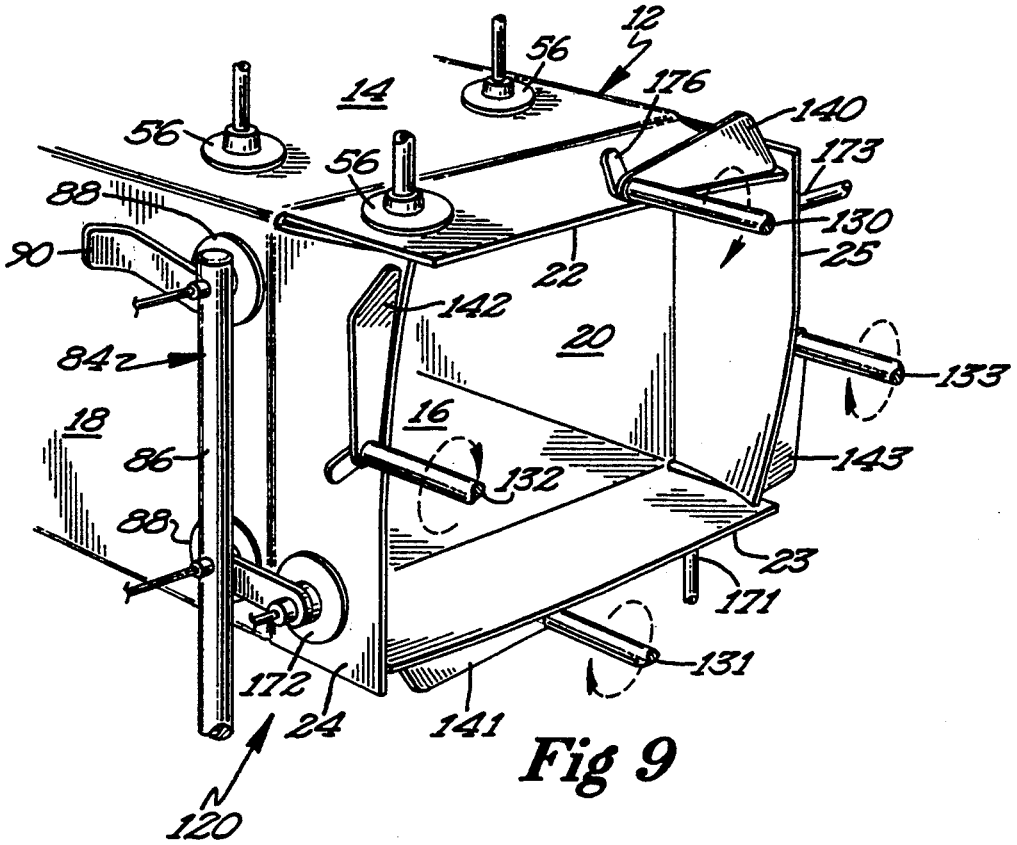
FIG. 9 shows a diagramatic, perspective view of the fan folding device of FIG. 8.
Figure 10:
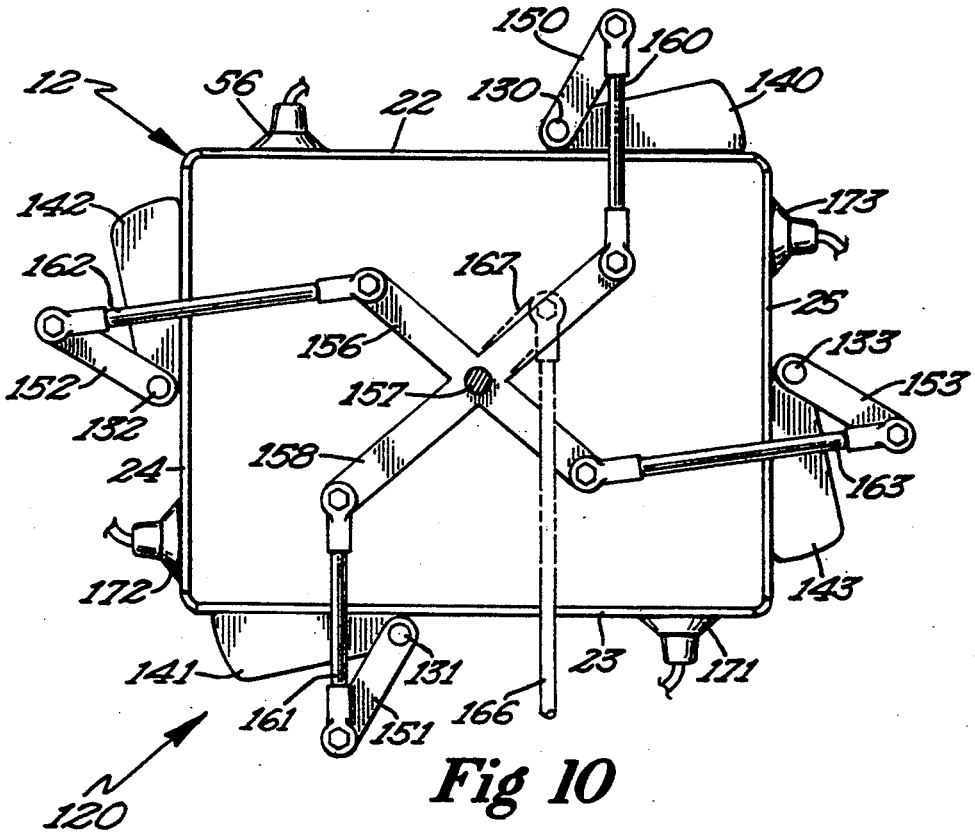
FIGS. 10 and 11 show diagramatic, end views of the fan folding device of FIG. 8.
Figure 11:
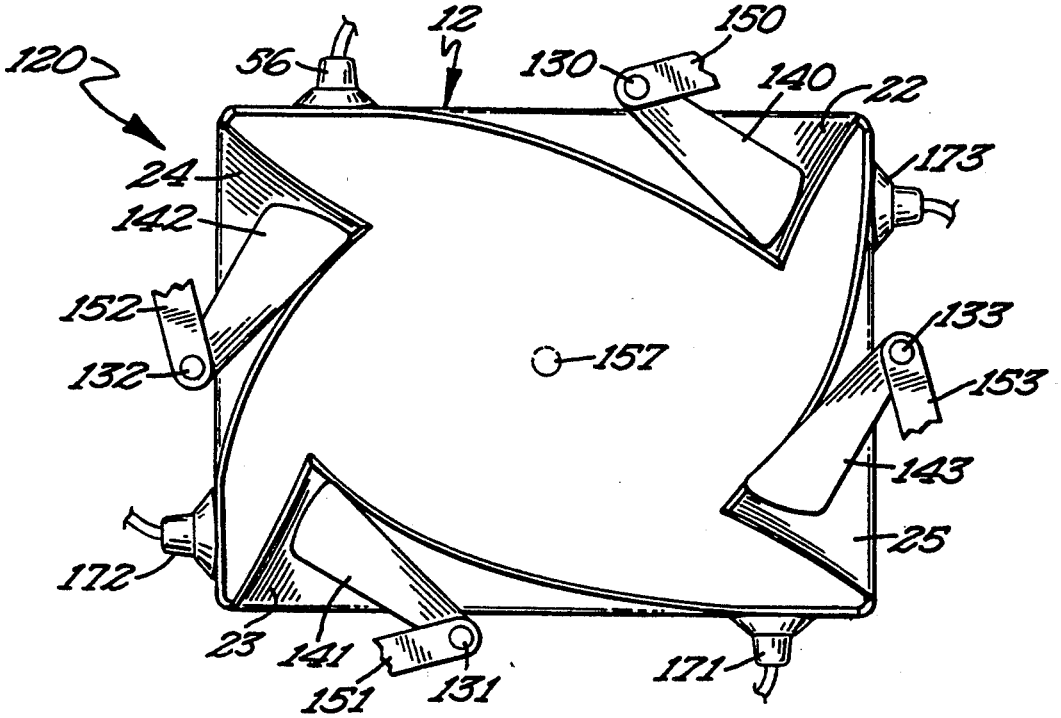
Figure 12:
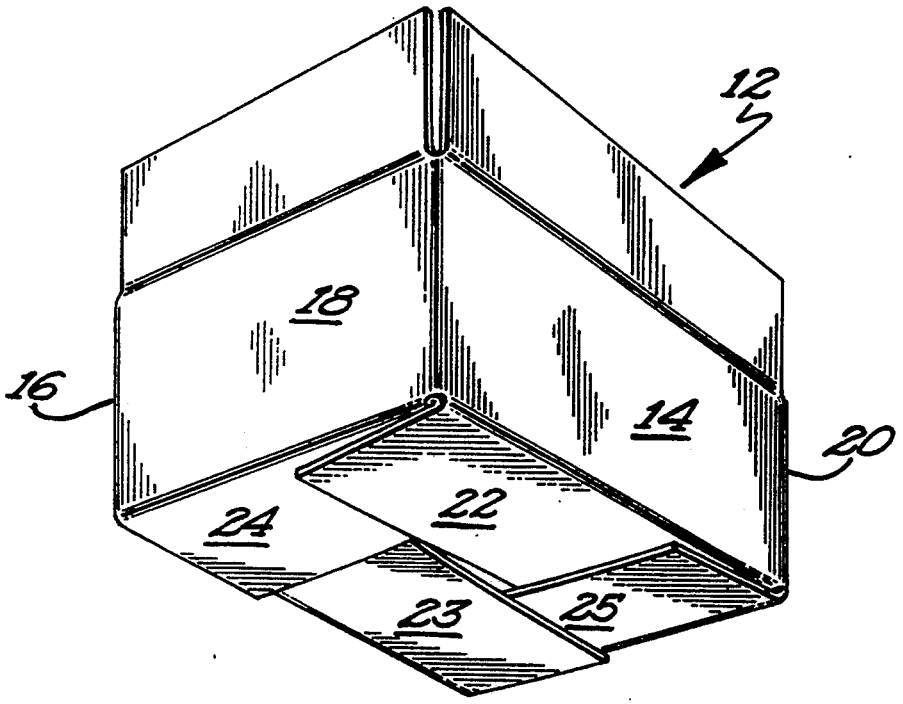
FIG. 12 Shows a perspective view of a carton as fan folded by the device of FIG. 8.

Apparatus 10 of the present invention is designed to transform cartons 12 from the collapsed tubular state shown in FIGS. 2, 3, and 4 to the open ended erected tubular state shown in FIGS. 1, 2, and 5–7 (and in phantom in FIG. 3). Apparatus 10 may take various forms but the illustrated embodiment includes a collapsed carton supply hopper 26 of any suitable design in which a supply of collapsed cartons 12 is positioned. In the preferred form, hopper 26 is vertically arranged with collapsed cartons 12 stacked upon a device 28 for raising or vertically lifting the stack of collapsed cartons 12. For example, device 28 in the preferred form is a scissor lift which is electrically controlled by a trigger 30 which rests upon and is supported by panel 18 in the preferred form. Thus, when the top carton 12 is removed from the top of the stack of cartons 12 supported upon lifting device 28 and from under trigger 30, device 28 is actuated to raise the stack of collapsed cartons 12 until the next carton 12 (then the top) of the stack of cartons 12 engages with trigger 30 which stops further actuation of lifting device 28.

Apparatus 10 further includes a device 32 for removing carton 12 from the top of the stack of cartons 12 in hopper 26 and placing it at a horizontal position adjacent to hopper 26. In the most preferred form, a horizontal shaft 34 is rotatably mounted extending parallel to and spaced from the free edges of flaps 22–25 and spaced slightly above the top carton 12 in hopper 26. Shaft 34 is pivoted through a range of approximately 180° by any suitable means such as by a sprocket 36 driven by roller chain 38 extending around a sprocket 40 of a suitable drive. Device 32 further includes first and second arms 42 secured to and extending generally perpendicular from shaft 34, with the first and second arms 42 located on opposite sides of hopper 26. Rotation of shaft 34 causes the pivotal movement of arms 42 to move in a half-circle arc about shaft 34 between a horizontal, removal position located above and parallel to cartons 12 in hopper 26 and a horizontal, operative position generally horizontally offset from the removal position. A shaft 44 which in the preferred form is not circular in cross section and preferably square is pivotally mounted to and between the free ends of arms 42 spaced from and parallel to shaft 34. For keeping shaft 44 in the same rotational position relative to the support surface of apparatus 10 with the pivoting of arms 42, sprockets 46 and 48 are rotatably fixed to the frame and shaft 44 respectively and roller chain 50 extends therebetween. A plurality of support arms 52–54 are secured generally perpendicular to shaft 44 and in a spaced parallel relation. A plurality of suction cups 56 are secured to each of arms 52–54, with suction cups 56 of arm 52 attaching to panels 18 and 24, suction cups 56 of arm 53 attaching to panels 22 on the opposite sides of panel 14, and suction cups 56 of arm 54 attaching to panels 14 and 22 in the most preferred form.

In operation of device 32 of the most preferred form and assuming arms 42 are in their removal position with suction cups 56 abutting with and attached to the top carton 12 of hopper 26, shaft 34 is rotated by rotating sprocket 36 through roller chain 38. Due to its attachment through cups 54 and 56, arms 52, and shaft 44 to arms 42, the top carton 12 will be raised from hopper 26 when arms 42 are pivoted from their removal position towards their operative position. It should further be noted that the attachment of suction cups 56 holds panel 18 generally linearly with panel 14 to thus maintain carton 12 in its collapsed condition. Additionally, sprockets 46 and 48 and roller chain 50 in the most preferred form maintain arms 52–54 and carton 12 attached thereto in a horizontal condition generally parallel to the stacked cartons 12 in hopper 26 as arms 42 pivot from their removal position to their operative position. After suction cups 56 have released carton 12 as will be explained later, arms 42 can be pivoted from their operative position to their removal position with suction cups 56 abutting with and attached to the next carton 12 which will then be in the top position of hopper 26. It should be noted that when carton 12 is removed from hopper 26 and from beneath trigger 30, device 28 is actuated to raise the stack of collapsed cartons 12 until the next carton 12 engages trigger 30 as set forth previously.

In the most preferred form, apparatus 10 further includes a flange 58 for abutting with the free outer edge of flap 24 for sealing the bottom of carton 12. In the most preferred form, flange 58 is spaced above the top carton 12 in hopper 26 and in the path of carton 12 after its removal from hopper 26 by device 32. Since flap 24 is not held by a suction cup 56 of device 32, flap 24 will deflect downward from panel 18 about its hinge connection therewith when the free outer edge engages flange 58. It can then be appreciated that this deflection will break the rigidity along the hinged connection of flap 24 and panel 18 of any new cartons 12 which have not been previously opened or erected. This breaking has been found to allow for ease of folding flap 24 relative to panel 18 for sealing the bottom of carton 12.

Apparatus 10 further includes a movable shelf 60 for support of and attachment to panel 16, with shelf 60 being movable from an attachment position to an open position. In the most preferred form, shelf 60 includes first and second arms 62 and 64 pivotally mounted about spaced, parallel axes 66 and 68 extending generally parallel to the hinge connections between panels 14, 16, 18, and 20. Rods 70 and 72 extend from the lower free ends of arms 62 and 64 vertically below and generally parallel to axes 66 and 68, with the spacing between axis 66 and rod 70 being equal to the spacing between axis 68 and rod 72. A frame 74 having a generally H-configuration has its opposite ends pivotally mounted to rods 70 and 72, with the spacing between rods 70 and 72 being equal to the spacing between axes 66 and 68. Suction cups 76 are attached to frame 74 in a single linear arrangement extending generally perpendicular between rods 70 and 72. It can then be appreciated that a parallelogram mounting is provided for keeping frame 74 vertically below, horizontal and parallel to the plane of axes 66 and 68. Frame 74 and suction cups 76 have a size corresponding to panel 16, with suction cups 76 located on panel 16 adjacent and parallel to the hinge connection with flap 23. Frame 74 and suction cups 76 are movable between the attachment position and the open position in the most preferred form by a rod 78 pivotally connected to arm 62 and reciprocal by any suitable means such as that illustrated. A connection rod 80 extends between arms 62 and 64 to insure simultaneous, parallelogram movement of arms 62 and 64. In its attachment position, frame 74 and suction cups 76 are vertically below and abut with panel 16 of carton 12 in its collapsed condition abutting with panel 18. In its attachment position, suction cups 76 can be attached to panel 16. After release of suction cups 56 of arm 52, frame 74 and suction cups 76 can be moved to its open position located vertically below, parallel to and coinciding with panel 14 and spaced therefrom generally equal to the width of panels 18 and 20. Due to the attachment of suction cups 76 to panel 16, movement of frame 74 and suction cups 76 to its open position causes carton 12 to also open with panels 18 and 20 pivoting about their hinge connections to panels 14 and 16 in a parallelogram movement corresponding to the parallelogram movement of frame 74 and suction cups 76 relative to shaft 44, arms 53 and 54 and suction cups 56 secured thereto. As panel 14 is attached to suction cups 56 of arms 53 and 54 and panel 16 is attached to suction cups 76, a horizontal, parallel relationship is maintained between panels 14 and 16 during movement of frame 74 from the attachment position to the open position.

It should then be appreciated that panel 14 is firmly supported by suction cups 56 to maintain a planar configuration. Likewise, panel 16 is supported by and attached to frame 74 by suction cups 76 to maintain a planar configuration (with suction cups 76 located adjacent to and parallel the hinge connection with flap 23). Additionally, panels 18 and 20 maintain their planar configuration due to their parallelogram movement relative to panels 14 and 16. Thus, apparatus 10 is able to open cartons 12 from a collapsed condition of various degrees of rigidity from being not previously opened to being opened and collapsed a multiple number of times, and with cartons 12 of intermixed degrees of rigidity without handling difficulties.

In the most preferred form, apparatus 10 includes provisions for mechanically folding flaps 22–25 to seal the bottom of carton 12. In the preferred form, a stationary bending bar 82 engages with flap 23 and moves it from a position extending generally linearly with panel 16 to a position extending generally perpendicular with panel 16 and towards panel 14 as panel 16 is moved from the collapsed condition to the open position. It should be noted that due to the position of suction cups 76 adjacent to the hinge connection between panel 16 and flap 23, flap 23 will tend to fold along the hinge connection and will not tend to fold at other, undesired locations even if carton 12 has been reused multiple times or has not been previously used.

Apparatus 10 in the most preferred form, further generally includes an unload arm 84. Arm 84 generally includes a rod 86 including multiple suction cups 88 mounted thereto for connection to panel 18 adjacent to the hinge connection between panel 18 and flap 24. Support flanges 90 extend from rod 86 and abut with panel 18 spaced from its hinge connection with flap 24 and on the opposite side of rod 86. Rod 86 is pivotally mounted in the upstanding legs of a U-shaped support 92. Support 92 is pivotable 90° between a vertical, pickup position and a horizontal, drop position about an axis extending perpendicular to rod 86. In the preferred form, a shaft 94 extending along the pivot axis of support 92 is secured to the central portion of support 92 from which the legs of support 92 upstand and parallel to the direction of the legs of support 92. Shaft 94 can be rotated by any suitable means such as by a crank arm 96 as shown. Rod 86 is simultaneously rotated 90° in support 92 between first and second conditions as support 92 is pivoted between its pickup and drop positions. In the most preferred form, a crank arm 98 extends generally perpendicular from rod 86 intermediate the legs of U-shaped support 92. A turnbuckle 100 extends from the free end of arm 98 and a stationary portion or reference point of the frame of apparatus 10. As support 92 is pivoted between the pickup position and the drop position, arm 98 and turnbuckle 100 rotate rod 86 between a first condition with suction cups 88 in a plane perpendicular to the plane of the central portion of support 92 when rod 86 and support 92 are in the pickup position and a second condition with suction cups 88 in a plane parallel to the plane of the central portion of support 92 when rod 86 and support 92 are in the drop position. In the most preferred form, rod 86 and support 92 are in the drop position as frame 74 moves from the attachment position towards the open position and moves to the pickup position in a non-interfering manner with frame 74. In the pickup position, flanges 90 abut with panel 18 and suction cups 88 attach to panel 18. It can be appreciated that once carton 12 is attached to suction cups 88 and to suction cups 76, carton 12 is held in an open condition as panels 16 and 18 are held perpendicularly to each other. In the most preferred form, a stationary abutment 101 is positioned to abut with panel 20 to assist in holding carton 12 in the open condition. Anytime thereafter, suction cups 56 of device 32 can be released depending upon the additional support for panel 14 desired, with device 32 moving from its operative position to its removal position after release of suction cups 56.

Apparatus 10 further includes tucking arms 102, 104, and 106 pivotally mounted about axes 108, 110, and 112, respectively, and each are pivotable between a non-interfering position and a tucking position. Specifically, arm 102 pivots about axis 108 extending perpendicular to the hinge connection between panel 18 and flap 24 and generally parallel to panel 16 and folds flap 24 relative to panel 18 from a position extending generally linearly from panel 18 to a position extending generally perpendicular to panel 18 towards panel 20 as it moves from its non-interfering position to its tucking position after securement of suction cups 88 to panel 18. Similarly, arm 104 pivots about axis 110 extending generally perpendicular to the hinge connection between panel 14 and flap 22 and generally parallel to panel 14 and axis 108 and folds flap 22 relative to panel 14 from a position extending generally linearly from panel 14 to a position extending generally perpendicular to panel 14 towards panel 16 as it moves from its non-interfering position to its tucking position, with flap 22 moving after flap 24. Likewise, arm 106 pivots about axis 112 extending generally perpendicular to the hinge connection between panel 20 and flap 25 parallel to panel 20, and perpendicular to axes 108 and 110 and folds flap 25 relative to panel 20 from a position extending generally linearly from panel 20 to a position extending generally perpendicular to panel 20 towards panel 18 as it moves from its non-interfering position to its tucking position, with flap 25 moving after flap 22. In the most preferred form, arm 106 carries a taping machine 114 such as of the type manufactured by Prototype Equipment Corporation for attaching a tape piece 116 extending between and adhered to flap 25 and panel 16. In the preferred form of the present invention, additional taping of the bottom of carton 12 occurs in additional operations after apparatus 10. It can be appreciated that arms 102, 104, and 106 can be pivoted from their tucking positions to their non-interfering positions after placement of later flaps and/or tape piece 116. Arms 102, 104, and 106 can be pivoted about axes 108, 110, and 112, respectively, by any suitable means such as by connecting rods having their opposite ends connected to crank arms attached to rotatable shafts, with the crank arms for arms 102 and 104 being connected to the same rotatable shaft for simultaneous movement therewith in the most preferred form.

After tape piece 116 has been applied, after suction cups 76 have been released, and after device 32 has moved away from its operative position, unload arm 84 can move from its pickup position to its drop position. Particularly, moving from its pickup position, arm 84 lifts carton 12 having panel 16 resting upon frame 74 and extending generally horizontally and the sealed bottom of carton 12 extending generally vertically. In its drop position, arm 84 places carton 12 in a chute 118 diagonally offset from frame 74 and with panels 14, 16, 18, and 20 extending generally vertically and the sealed bottom of carton 12 extending generally horizontally. When carton 12 is located in chute 118, suction cups 88 can be released allowing carton 12 to pass into chute 118 for further processing as desired. It should be noted that support flanges 90 support carton 12 and prevent pivotal-type movement of carton 12 around rod 86 as rod 86 is pivoted about shaft 94 and rotated in support 92.

After carton 12 is moved by arm 84 in a non-interfering relation with frame 74, frame 74 and suction cups 76 can move from their open position to their attachment position for securement to the next collapsed carton 12 to be erected.

Now that the construction and operation of apparatus 10 according to the preferred teachings of the present invention have been explained, further subtle features and advantages of apparatus 10 can be set forth and appreciated. Particularly, to allow ease and reduction of handling, it is desired that collapsed cartons 12 be presented to apparatus 10 in a vertically stacked condition such as in hopper 26 of the most preferred form with removal of cartons 12 occurring from the top of the stack of collapsed cartons 12. Device 32 is then particularly advantageous in being able to present cartons 12 to be erected from the top of a stack of collapsed cartons 12 and in doing so in a mechanically simple manner. Particularly, utilizing a motion and mechanism similar to that shown and described in U.S. Pat. No. 4,917,229, device 32 is able to remove and place carton 12 in a collapsed condition in a generally vertical manner while moving carton 12 to a horizontally offset location from hopper 26. Specifically, although horizontal movement occurs during movement along the half-circle arc, movement of cartons 12 at the beginning and ending of the half-circle arc is generally vertical with the horizontal movement component being minimal at those points of the arc. Additionally, cartons 12 are held in a horizontal orientation to minimize the overall height required for apparatus 10. Device 32 is then able to utilize a motion and mechanism similar to that shown and described in U.S. Pat. No. 4,917,229 for a different purpose as a solution to the particular manner of carton presentation desired in the environment of carton removal and placement.

Likewise, although it has been known to erect a collapsed tubular carton positioned between flights of a lower conveyor by attaching to and vertically raising the top panel utilizing a parallelogram movement assembly for positioning between flights of an upper conveyor for additional operations while held by the flights of the upper and lower conveyors, apparatus 10 of the preferred form is able to erect carton 12 (and in the most preferred form to seal the bottom) utilizing a similar but inverted movement. This is particularly advantageous as apparatus 10 utilizes gravitational forces acting upon panels 16, 18, and 20 and flaps 22, 24 and 25 connected thereto to erect cartons 12 such that the amount of energy and attachment suction required is reduced. In fact, for cartons 12 which have been reused many times, frame 74 and suction cups 76 of apparatus 10 in fact often slow and control the fall of panel 16 after release of suction to cups 56 of arm 52 due to the lack of rigidity of such reused cartons 12 as compared to previously unused cartons 12. Additionally, apparatus 10 does not require the use of flight conveyors, which substantially reduces the size requirement of apparatus 10. Additionally, apparatus 10 further allows sealing the bottom of cartons 12 while still being held by shelf 60 (and by device 32 and/or arm 84) such that later packaging stations are not needed to seal the bottom to further reduce the size and complexity of apparatus 10.

Furthermore, although in one preferred form apparatus 10 seals the bottom of carton 12 utilizing tape piece 116, apparatus 10 can optionally include a device 120 for fan folding flaps 22–25 so that tape is not required to seal the bottom of carton 12. Particularly, in a preferred form, device 120 generally includes a carriage 122 which is slideably mounted by suitable linear bearings on slide shafts 124. Carriage 122 is reciprocated by a crank arm 126 having a first end connected to a rotatable shaft 128 and a second end pivotally connected to an end of a turnbuckle 130. The opposite end of turnbuckle 130 is in turn pivotably mounted to carriage 122. By rotating shaft 128 by any suitable means such as the crank arm as shown, carriage 122 can be reciprocated between an inner position and an outer position.

Carriage 122 rotatably mounts first, second, third, and fourth tubes 130, 131, 132, and 133 about horizontal, parallel axes. The free ends of tubes 130, 131, 132, and 133 include folding arms 140, 141, 142, and 143, respectively, extending generally perpendicular to tubes 130–133 and their axes of rotation. Tube 130 is positioned horizontally above and parallel to panel 14 and the hinge connections of panel 14 to panels 18 and 20. Tube 130 is spaced from the hinge connection between panels 14 and 20 slightly more than the width of flap 25. Tube 131 is positioned horizontally below and parallel to panel 16 and the hinge connections of panel 16 to panels 18 and 20. Tube 131 is spaced from the hinge connection between panels 16 and 18 slightly more than the width of flap 24. Tube 132 is positioned vertically outwardly and parallel to panel 18 and the hinge connections of panel 18 to panels 14 and 16. Tube 132 is spaced from the hinge connection between panels 14 and 18 slightly more than the width of flap 22. Tube 133 is positioned vertically outwardly and parallel to panel 20 and the hinge connections of panel 20 to panels 14 and 16. Tube 133 is spaced from the hinge connection between panels 16 and 20 slightly more than the width of flap 23.

Suitable provisions are provided for simultaneously pivoting tubes 130–133 and thus folding arms 140–143. In the preferred form, a lever arrangement is utilized. Particularly, each tube 130–133 includes a crank arm 150–153 secured generally perpendicular to the end opposite folding arms 140–143 and at an acute angle to folding arms 140–143 in the order of 60°. First and second straight links 156 and 158 are secured together in an X-shape and are pivotably mounted to carriage 122 about an axis 157 extending parallel to and within the axes of tubes 130–133, located intermediate the ends of links 156 and 158 and located at the interconnection of links 156 and 158. A turnbuckle 160 extends from the free end of crank arm 150 and the upper, free end of link 156. A turnbuckle 161 extends from the free end of crank arm 151 and the lower, free end of link 156. A turnbuckle 162 extends from the free end of crank arm 152 and the upper, free end of link 158. A turnbuckle 163 extends from the free end of crank arm 153 and the lower, free end of link 158. Links 156 and 158 can be pivoted about axis 157 by any suitable means such as by a reciprocating rod 166 pivotally attached to the free end of a crank arm 167 having the opposite end connected to axis 157. Specifically, by reciprocating rod 166 by any suitable means such as the crank arm as shown, crank arm 167 pivots axis 157 to pivot links 156 and 158. Due to the interconnection of turnbuckles 160 and 161 to link 156, pivoting of link 156 also pivots crank arms 150 and 151 about the axes of tubes 130 and 131 to pivot folding arms 140 and 141. Due to the interconnection of turnbuckles 162 and 163 to link 158, pivoting of link 158 also pivots crank arms 152 and 153 about the axes of tubes 132 and 133 to pivot folding arms 142 and 143. It should be noted that folding arms 140–143 simultaneously pivot in the same direction about the axes defined by tubes 130–133.

Suction cup 56 is secured to support arm 53 for attachment adjacent to the outer corner of flap 22 opposite to flap 25 when flap 22 is linear with panel 14. Similarly, a suction cup 171 is secured to shelf 60 for attachment adjacent to the outer corner of flap 23 opposite to flap 24 when flap 23 is linear with panel 16. Likewise, a suction cup 172 is movable with unload arm 84 for attachment adjacent to the outer corner of flap 24 opposite to flap 22 when flap 24 is linear with panel 18, with suction cup 172 either directly secured to unload arm 84 as shown or can be mounted with suitable linkage to move relative to unload arm 84 to avoid chute 118. Additionally, a stationary suction cup 173 is secured to the frame of apparatus 10 for attachment adjacent to the outer corner of flap 25 opposite to flap 23 when flap 25 is linear with panel 20. Suction cups 56 and 171–173 are positioned in the preferred form approximately 40% of the width of flaps 22–25 from their free edges and draw the outer corners of flaps 22–25 slightly outward of their planar condition with panels 14, 16, 18, and 20. A stop is secured to shelf 60 for holding flap 23 and for lifting the outer corner of flap 23 opposite flap 25 toward the center. Similarly, a stationary stop is secured to the frame of apparatus 10 for holding flap 25 and for lifting the outer corner of flap 25 opposite flap 22 toward the center.

In operation and for sake of illustration, it will be assumed that carriage 122 is located in its outer position and folding arms 140–143 are in their start position and particularly with their leading edges generally in the same plane as flaps 22–25. Carriage 122 is moved from its outer position towards its inner position. When folding arms 140–143 are in line with the outside edges of flaps 22–25, folding arms 140–143 are simultaneously rotated about the axes of tubes 130–133 while carriage 122 continues to move towards its inner position. It can then be appreciated that rotation of folding arms 140–143 pushes one end of the respective flaps 22–25 toward the center while the forward movement of folding arms 140–143 due to the movement of carriage 122 pushes the end of the respective flaps 22–25 forward toward the top of carton 12 while suction cups 56 and 171–173 hold the opposite corner of the respective flaps 22–25. Thus, suction cup 56 insures that the corner of flap 22 adjacent flap 24 is held generally planar to panel 14 until folding arm 142 folds the end of flap 24 inward in front of flap 22 at which time vacuum to suction cup 56 can be released. Simultaneously, suction cup 172 insures that the corner of flap 24 adjacent flap 23 is held generally planar to panel 18 until folding arm 141 folds the end of flap 23 inward in front of flap 24 at which time vacuum to suction cup 172 can be released. Simultaneously, suction cup 173 insures that the corner of flap 25 adjacent flap 22 is held generally planar to panel 20 until folding arm 140 folds the end of flap 22 inward in front of flap 25 at which time vacuum to suction cup 173 can be released. Simultaneously, suction cup 171 insures that the corner of flap 23 adjacent flap 25 is held generally planar to panel 16 until folding arm 143 folds the end of flap 25 inward in front of flap 23 at which time vacuum to suction cup 171 can be released. It can then be appreciated that the simultaneous pushing of the outer corners of flaps 22–25 inward and forward (while the opposite corners of flaps 22–25 are held by suction cups 56 and 171–173) causes the outer corners of flaps 22–25 to twist inward and inside of the outer corners of the respective adjacent flaps 22–25. In the most preferred form, folding arms 140–143 have a lead-in-plow 176 located straight ahead of tubes 130–133 to guide flaps 22–25 inside fold arms 140–143.

Once folding arms 140–143 enter flaps 22–25 about 60% of their width, the vacuum to suction cups 56 and 171–173 attached to flaps 22–25 can be released. After release of suction cups 56 and 171–173, folding arms 140–143 continue to rotate about the axes of tubes 130–133 and to move forward with carriage 122. In the most preferred form, the folding ends of folding arms 140–143 have a width generally equal to 50% of the width of flaps 22–25 to restrict or hold back the portion of flaps 22–25 that suction cups 56 and 171–173 previously controlled. Folding arms 140–143 have a 15° angle so that the back sides of folding arms 140–143 push flaps 22–25 in further than the lead sides that twist flaps 22–25 inward. This angle of folding arms 140–143 also allows all four folding arms 140–143 to miss each other as they finish folding flaps 22–25. In the most preferred form, folding arms 140 and 141 rotate slightly faster than folding arms 142 and 143 due to the selection of the relative lengths of turnbuckles 162 and 163 relative to those of turnbuckles 160 and 161 and the angle between links 156 and 158 to avoid engagement of folding arms 140–143 with one another, with folding arms 140 and 141 rotating 125° while folding arms 142 and 143 rotate 110° in the preferred form. When carriage 122 reaches its inner position, the bottom of carton 12 is closed and extends generally perpendicular to panels 14, 16, 18, and 20 and folding arms 140–143 are positioned outside of all flaps 22–25. Specifically, folding arm 140 has pivoted to be positioned on flap 22 beyond flap 25. Likewise, folding arm 141 has pivoted to be positioned on flap 23 beyond flap 24. Similarly, folding arm 142 has pivoted to be positioned on flap 24 beyond flap 22. Additionally, folding arm 143 has pivoted to be positioned on flap 25 beyond flap 23. Carriage 122 can then be moved from its inner position to its outer position. Thereafter, carton 12 can be lifted by arm 84 and placed in chute 118 in a manner as previously set forth, and folding arms 140–143 can be pivoted back to their start position, with operation being repeated on the next carton 12.

It should be noted that the use of suction cups 56 and 171–173 for holding the corners of flaps 22–25 while the opposite corners of flaps 22–25 are being twisted inward by folding arms 140–143 is especially important when erecting used cartons 12. Specifically, cartons 12 which have been previously used are not as rigid as new cartons 12, with flaps 22–25 of used cartons 12 potentially moving under gravitational and momentum forces prior to movement by folding arms 140–143 and/or with folding arms 140–143 pivoting entire flaps 22–25 rather than twisting one corner thereof as desired in the present invention.

It should then be appreciated that fan folding the bottom of carton 12 results in several advantages over sealing the bottom of carton 12 with tape piece 116. Specifically, fan folding the bottom of carton 12 eliminates tape piece 116 or similar agent such as glue to hold bottom closure flaps 22–25. Thus, carton 12 is easier to handle by the customer to collapse for transport back to the factory or similar location for reuse. Specifically, it is not necessary for the customer to remove tape piece 116 or similar agent before collapse of carton 12. Additionally, it is not necessary to dispose of tape piece 116 or similar agent before reuse, making carton 12 more environmentally friendly. Likewise, damage to carton 12 from multiple adherence and removal of tape pieces 116 is avoided, extending the potential life of carton 12. Additionally, failure of tape piece 116 or similar agent during handling of carton 12 including product contained therein is no longer a concern.

Furthermore, the complexity of apparatus 10 can be reduced when the bottom closure flaps 22–25 of carton 12 are fan folded. Specifically, taping machine 114 or other devices for applying tape piece 116 or similar agent is not necessary. Thus, no knives for cutting tape are necessary, eliminating maintenance and user injury. Likewise, the controls for taping machine 114 including air cylinders and air pressure therefor can be eliminated. Likewise, it is not necessary to provide a supply such as a tape roll or the like for taping machine 114 or other devices for applying tape piece 116 or similar agent.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for erecting a collapsed carton, with the carton including first, second, third, and fourth side panels connected together about hinge connections, with the second and fourth panels being spaced and located intermediate the first and third side panels, with the carton including first and second major bottom closure flaps connected to the first and third side panels and first and second minor bottom closure flaps connected to the second and fourth side panels, comprising, in combination: a frame for supporting the third panel and including means for removable securement to the third panel; means for moving the frame from an attachment position and an open position, with the frame in the attachment position being vertically above and horizontally offset from the open position, with the frame being horizontally orientated in the attachment and open positions and intermediate the attachment and open positions; means for placing the carton at an operative position with the first and second panels in a linear arrangement and the third and fourth panels in a linear arrangement, with the third panel located vertically below and underlying at least the second panel and with the frame in the attachment position abutting the third panel, with the placing means holding the first panel at an operative position while the frame moves from the attachment position to the open position, with the closure flaps extending generally linearly to the first, second, third, and fourth panels in the operative position, with the closure flaps each including first and second outside corners; and means for pushing the first corner of the first major closure flap simultaneously inward and forward and prior to the second corner of the first minor closure flap, for pushing the first corner of the first minor closure flap simultaneously inward and forward and prior to the second corner of the second major closure flap, for pushing the first corner of the second major closure flap simultaneously inward and forward and prior to the second corner of the second minor closure flap, and for pushing the first corner of the second minor closure flap simultaneously inward and forward and prior to the second corner of the first major closure flap, with the first corners of the first and second major closure flaps and of the first and second minor flaps being pushed simultaneously until extending generally perpendicularly to the panels of the carton and forming the bottom of the carton.

2. The device of claim 1 further comprising, in combination: first means for holding the second corner of the first major flap when the closure flaps are initially pushed to insure that the first corner of the second minor closure flap is positioned forward of the second corner of the first major closure flap when the closure flaps extend generally perpendicular to the side panels; second means for holding the second corner of the first minor flap when the closure flaps are initially pushed to insure that the first corner of the first major closure flap is positioned forward of the second corner of the first minor closure flap when the closure flaps extend generally perpendicular to the side panels; third means for holding the second corner of the second major flap when the closure flaps are initially pushed to insure that the first corner of the first minor closure flap is positioned forward of the second corner of the second minor closure flap when the closure flaps extend generally perpendicular to the side panels; and fourth means for holding the second corner of the second minor flap when the closure flaps are initially pushed to insure that the first corner of the second minor closure flap is positioned forward of the second corner of the second major closure flap when the closure flaps extend generally perpendicular to the side panels.

3. The device of claim 2 wherein the placing means includes the first means for holding the second corner of the first major flap; and wherein the frame includes the third means for holding the second corner of the second major flap.

4. The device of claim 3 further comprising, in combination: an attachment arm movable between a pickup position and a drop position, with the attachment arm including means for attaching to the second panel and the second means for holding the second corner of the first minor closure flap.

5. The device of claim 4 wherein the fourth means for holding the second corner of the second minor flap is stationary.

6. Device for fan folding the first and second major closure flaps and the first and second minor closure flaps of the bottom of a tubular carton, with the closure flaps having hinged connections to side panels of the tubular carton and extending generally linearly to the side panels, with the closure flaps each including first and second outside corners, comprising, in combination: means for pushing the first corner of the first major closure flap simultaneously inward and forward and prior to the second corner of the first minor closure flap, for pushing the first corner of the first minor closure flap simultaneously inward and forward and prior to the second corner of the second major closure flap, for pushing the first corner of the second major closure flap simultaneously inward and forward and prior to the second corner of the second minor closure flap, and for pushing the first corner of the second minor closure flap simultaneously inward and forward and prior to the second corner of the first major closure flap, with the first corners of the first and second major closure flaps and of the first and second minor flaps being pushed simultaneously until extending generally perpendicularly to the side panels of the carton and forming the bottom of the carton.

7. The device of claim 6 further comprising, in combination: first means for holding the second corner of the first major flap when the closure flaps are initially pushed to insure that the first corner of the second minor closure flap is positioned forward of the second corner of the first major closure flap when the closure flaps extend generally perpendicular to the side panels; second means for holding the second corner of the first minor flap when the closure flaps are initially pushed to insure that the first corner of the first major closure flap is positioned forward of the second corner of the first minor closure flap when the closure flaps extend generally perpendicular to the side panels; third means for holding the second corner of the second major flap when the closure flaps are initially pushed to insure that the first corner of the first minor closure flap is positioned forward Of the second corner of the second minor closure flap when the closure flaps extend generally perpendicular to the side panels; and fourth means for holding the second corner of the second minor flap when the closure flaps are initially pushed to insure that the first corner of the second minor closure flap is positioned forward of the second corner of the second major closure flap when the closure flaps extend generally perpendicular to the side panels.

8. The device of claim 7 wherein the pushing means comprises, in combination: a first folding arm for pushing the first corner of the first major closure flap; a second folding arm for pushing the first corner of the first minor closure flap; a third folding arm for pushing the first corner of the second major closure flap; a fourth folding arm for pushing the first corner of the second minor closure flap; and means for moving the folding arms in a direction parallel to the side panels of the carton and perpendicular to the folding arms.

9. The device of claim 8 wherein the moving means comprises, in combination: a carriage; and means for slideably mounting the carriage for movement in the direction parallel to the side panels of the carton and perpendicular to the folding arms.

10. The device of claim 7 wherein the holding means each comprise a suction cup.

11. The device of claim 7 wherein the pushing means comprises, in combination: a first folding arm for pushing the first corner of the first major closure flap; a second folding arm for pushing the first corner of the first minor closure flap; a third folding arm for pushing the first corner of the second major closure flap; a fourth folding arm for pushing the first corner of the second minor closure flap; and means for simultaneously pivoting the first, second, third, and fourth folding arms about first, second, third, and fourth axes extending parallel to the side panels of the cartons and perpendicular to the folding arms.

12. The device of claim 11 wherein the pushing means further comprises, in combination: means for moving the folding arms in a direction parallel to the axes of the folding arms.

13. The device of claim 12 wherein the moving means comprises, in combination: a carriage, with the folding arms being pivotally mounted to the carriage; and means for slideably mounting the carriage for movement in the direction parallel to the axes of the folding arms between an inner position and an outer position.

14. The device of claim 13 wherein the simultaneously pivoting means comprises, in combination: first, second, third, and fourth crank arms movable with the first, second, third, and fourth folding arms, respectively, with the crank arms extending perpendicular to the axes of the folding arms; and linkage means for simultaneously pivoting the first, second, third, and fourth crank arms about the axes in the same direction.

15. The device of claim 14 wherein the linkage means comprises, in combination: first and second links secured together at an interconnection in an X-shape, with the first and second links being pivotally mounted to the carriage about an axis parallel to the axes of the folding arms and at the interconnection of the first and second links; first means pivotally connected to the first crank arm and an end of the first link; second means pivotally connected to the third crank arm and an opposite end of the first link; third means pivotally connected to the second crank arm and an end of the second link; and fourth means pivotally connected to the fourth crank arm and an opposite end of the second link; and means for pivoting the first and second links about the axis of the first and second links.

16. The device of claim 11 wherein the simultaneously pivoting means comprises, in combination: first, second, third, and fourth crank arms movable with the first, second, third, and fourth folding arms, respectively, with the crank arms extending perpendicular to the axes of the folding arms; and linkage means for simultaneously pivoting the first, second, third, and fourth crank arms about the axes in the same direction.

17. The device of claim 16 wherein the linkage means comprises, in combination: first and second links secured together at an interconnection in an x-shape, with the first and second links being pivotally mounted to the carriage about an axis parallel to the axes of the folding arms and at the interconnection of the first and second links; first means pivotally connected to the first crank arm and an end of the first link; second means pivotally connected to the third crank arm and an opposite end of the first link; third means pivotally connected to the second crank arm and an end of the second link; and fourth means pivotally connected to the fourth crank arm and an opposite end of the second link; and means for pivoting the first and second links about the axis of the first and second links.

18. The device of claim 6 wherein the pushing means comprises, in combination: a first folding arm for pushing the first corner of the first major closure flap; a second folding arm for pushing the first corner of the first minor closure flap; a third folding arm for pushing the first corner of the second major closure flap; a fourth folding arm for pushing the first corner of the second minor closure flap; means for simultaneously pivoting the first, second, third, and fourth folding arms about first, second, third, and fourth axes extending parallel to the side panels of the cartons and perpendicular to the folding arms; and means for moving the folding arms in a direction parallel to the axes of the folding arms as the folding arms are being simultaneously pivoted about the first, second, third, and fourth axes.

19. Method for fan folding the first and second major closure flaps and the first and second minor closure flaps of the bottom of a tubular carton, with the closure flaps having hinged connections to side panels of the tubular carton and extending generally linearly to the side panels, with the closure flaps each including first and second outside corners, comprising the steps of: pushing the first corner of the first major closure flap simultaneously inward and forward and prior to the second corner of the first minor closure flap; pushing the first corner of the first minor closure flap simultaneously inward and forward and prior to the second corner of the second major closure flap; pushing the first corner of the second major closure flap simultaneously inward and forward and prior to the second corner of the second minor closure flap; and pushing the first corner of the second minor closure flap simultaneously inward and forward and prior to the second corner of the first major closure flap, with the first corners of the first and second major closure flaps and of the first and second minor flaps being pushed simultaneously until extending generally perpendicularly to the side panels of the carton and forming the bottom of the carton.

20. The method of claim 19 further comprising the steps of: holding the second corner of the first major flap when the closure flaps are initially pushed to insure that the first corner of the second minor closure flap is positioned forward of the second corner of the first major closure flap when the closure flaps extend generally perpendicular to the side panels; holding the second corner of the first minor flap when the closure flaps are initially pushed to insure that the first corner of the first major closure flap is positioned forward of the second corner of the first minor closure flap when the closure flaps extend generally perpendicular to the side panels; holding the second corner of the second major flap when the closure flaps are initially pushed to insure that the first corner of the first minor closure flap is positioned forward of the second corner of the second minor closure flap when the closure flaps extend generally perpendicular to the side panels; and holding the second corner of the second minor flap when the closure flaps are initially pushed to insure that the first corner of the second minor closure flap is positioned forward of the second corner of the second major closure flap when the closure flaps extend generally perpendicular to the side panels.

* * * * *